US007335624B2

(12) United States Patent
Senga et al.

(10) Patent No.: US 7,335,624 B2
(45) Date of Patent: Feb. 26, 2008

(54) REVERSIBLE THERMOCHROMIC DISPLAY ARTICLE

(75) Inventors: Kuniyuki Senga, Nagoya (JP); Katsuyuki Fujita, Nagoya (JP); Shigehiro Koide, Nagoya (JP)

(73) Assignee: The Pilot Ink Co., Ltd., Aichi (JP)

( * ) Notice: Subject to any disclaimer, the term of this patent is extended or adjusted under 35 U.S.C. 154(b) by 444 days.

(21) Appl. No.: 11/043,195

(22) Filed: Jan. 27, 2005

(65) Prior Publication Data

US 2006/0166822 A1 Jul. 27, 2006

(51) Int. Cl.
*B41M 5/30* (2006.01)

(52) U.S. Cl. ..... 503/201; 503/208; 503/215

(58) Field of Classification Search ..... None
See application file for complete search history.

(56) References Cited

U.S. PATENT DOCUMENTS 4,028,118 A 6/1977 Nakasuji et al.
4,720,301 A 1/1988 Kito et al.
4,732,810 A 3/1988 Kito et al.
6,165,234 A * 12/2000 Kanakkanatt ..... 44/275

FOREIGN PATENT DOCUMENTS

JP 2000-194295 A 7/2000

* cited by examiner

*Primary Examiner*—Bruce H. Hess
(74) *Attorney, Agent, or Firm*—Sughrue Mion, PLLC

(57) ABSTRACT

A reversible thermochromic display article which comprises a substrate and, formed thereon, a heat coloration image containing a heat coloration type reversible thermochromic composition which is colored by heating and is decolored by cooling and a heat decoloration image containing a heat decoloration type reversible thermochromic composition which is decolored by heating and is colored by cooling, or having a multilayer structure comprising a heat coloration layer containing the heat coloration type reversible thermochromic composition and a heat decoloration layer containing the heat decoloration type reversible thermochromic composition, wherein the heat coloration type reversible thermochromic composition is a microcapsule composition which contains, enclosed therein, (a) an electron-donating chromatic organic compound, (b)' an electron-accepting compound selected from gallic acid esters, and (c) a reaction medium having a melting point lower than 50° C. which is selected from alcohols, esters, ketones, and hydrocarbons and which causes color reactions between the two components to occur reversibly at specific temperatures.

11 Claims, 6 Drawing Sheets

REVERSIBLE THERMOCHROMIC DISPLAY ARTICLE

FIELD OF THE INVENTION

The present invention relates to reversible thermochromic display article. More particularly, the invention relates to reversible thermochromic display article which have both of a heat coloration image containing a heat coloration type reversible thermochromic composition and a heat decoloration image containing a heat decoloration type reversible thermochromic composition, or which have a multilayer structure comprising a heat coloration layer containing a heat coloration type reversible thermochromic composition and a heat decoloration layer containing a heat decoloration type reversible thermochromic composition.

BACKGROUND ART

Examples of heat decoloration type reversible thermochromic materials heretofore in use include a reversible thermochromic composition comprising a homogeneous compatibilized material which comprises the following three components: (a) an electron-donating chromic organic compound, (b) an electron-accepting compound, and (c) a reaction medium which determines the temperatures at which color reactions between the components (a) and (b) occur. This composition is extensively used in toys, printed matters, etc. (see, for example, patent document 1 to 3).

However, these reversible thermochromic materials each have a single thermochromic function, i.e., they are decolored by heating in a colored state and colored by cooling in a decolored state. Consequently, the visual effect of thermochromism brought about by heating or cooling has unavoidably been monotonous in some degree.

The applicant hence further proposed a reversible thermochromic display article employing a combination of a heat coloration image and a heat decoloration image (see, for example, patent document 4).

This reversible thermochromic display article can show a variety of thermochromic behaviors depending on combinations of a heat coloration image and a heat decoloration image, and has a remarkable visual effect rich in the niceties of color changes and in the surprising and magical nature thereof.

This reversible thermochromic display article is constituted of a heat coloration type reversible thermochromic material and a heat decoloration type reversible thermochromic material, and is characterized in that the heat coloration type reversible thermochromic material contains an alkoxyphenol compound and/or a hydroxybenozic ester compound as an electron-accepting compound, component (b)'.

[Patent Document 1]
U.S. Pat. No. 4,028,118

[Patent Document 2]
U.S. Pat. No. 4,732,810

[Patent Document 3]
U.S. Pat. No. 4,720,301

[Patent Document 4]
JP-A-2000-194295

SUMMARY OF THE INVENTION

However, the heat coloration type reversible thermochromic material employing an alkoxyphenol compound and/or a hydroxybenzoic ester compound as component (b)' has had the following problems: (1) the color density is slightly low; (2) in a process of coloration by heating in a decolored state, the color density at a maximum-coloration temperature gradually decreases when the material is further heated; (3) the temperature range in which color changes occur is limited and it is especially difficult to design the material to have a color change point at a temperature as low as 30-40° C.; and (4) after a complete-decoloration temperature $T_4$ is reached in decoloration by cooling, the color is completely eliminated only when the temperature is maintained for at least few minutes (sharpness in decoloration is poor).

The present inventors made intensive investigations in order to overcome the problems described above. As a result, it has been found that a heat coloration type reversible thermochromic material employing an electron-accepting compound selected from gallic acid esters as component (b)' is satisfactory in color density and color change behavior and can have color change temperatures selected in a wide range. It has been further found that when the heat coloration type reversible thermochromic material employing a gallic acid ester is used in combination with a heat decoloration type reversible thermochromic material, a reversible thermochromic display article is obtained which has excellent high-temperature coloration characteristics and sharpness of thermochromism.

Specifically, the present invention has the following constitution.

(1) A reversible thermochromic display article which comprises a substrate and, formed thereon, both of a heat coloration image which is an image colored by heating and contains a heat coloration type reversible thermochromic composition which is colored by heating in a decolored state and is decolored by cooling in a colored state, and a heat decoloration image which is an image decolored by heating and contains a heat decoloration type reversible thermochromic composition which is decolored by heating in a colored state and is colored by cooling in a decolored state, wherein the heat coloration type reversible thermochromic composition is a heat coloration type reversible thermochromic composition in the form of microcapsules which contains an encapsulated composition comprising three essential components consisting of (a) an electron-donating chromatic organic compound, (b)' an electron-accepting compound selected from gallic acid esters, and (c) a reaction medium having a melting point lower than 50° C. which is selected from alcohols, esters, ketones, and hydrocarbons and which causes color reactions between the two components to occur reversibly at specific temperatures, the heat coloration type composition giving a temperature-color density curve in which the value of ΔH (hysteresis temperature range) is in the range of 3-40° C. and having an average particle diameter of 0.5-50 μm.

(2) The reversible thermochromic display article according to the above (1), wherein the heat coloration type reversible thermochromic composition comprises microcapsules containing at least the three components (a), (b)', and (c) enclosed therein and gives a temperature-color density curve in which the value of ΔH (hysteresis temperature range) is in the range of 7-40° C.

(3) The reversible thermochromic display article according to the above (1) or (2), wherein the heat coloration type reversible thermochromic composition comprises microcapsules containing enclosed therein at least the three components (a), (b)', and (c) and a fourth component which is (d) a compound selected from monomeric compounds having a melting point of 50° C. or higher and polymeric compounds having a softening point of 70° C. or higher, and gives a temperature-color density curve in which the value of ΔH (hysteresis temperature range) is in the range of 3-25° C.

(4) The reversible thermochromic display article according to any one of the above (1) to (3), wherein the heat coloration image and the heat decoloration image on the substrate are arranged side by side so as to be apart from or in contact with each other or arranged so that one of the images is partly or wholly superposed on the other.

(5) The reversible thermochromic display article according to the above (4), wherein the heat decoloration image partly overlies the heat coloration image, and the ratio of the area of that part of the heat decoloration image in which this image has been formed to the are a of that part of the heat decoloration image in which this image has not been formed is from 20:80 to 99:1 per $cm^2$.

(6) The reversible thermochromic display article according to the above (5), wherein the heat coloration image is in a decolored state when the heat decoloration image is in a colored state, and the heat coloration image is in a colored state when the heat decoloration image is in a decolored state.

(7) The reversible thermochromic display article according to the above (5) or (6), wherein the heat decoloration image in a colored state has a lightness of 4.0 or higher.

(8) The reversible thermochromic display article according to any one of the above (1) to (7), which has a non-thermochromic image formed on the substrate, the non-thermochromic image being disposed side by side with the heat coloration image or heat decoloration image or superposed thereon.

(9) A reversible thermochromic display article having a multilayer structure comprising a heat coloration layer which is a layer colored by heating and contains a heat coloration type reversible thermochromic composition which is colored by heating in a decolored state and is decolored by cooling in a colored state and a heat decoloration layer which is a layer decolored by heating and contains a heat decoloration type reversible thermochromic composition which is decolored by heating in a colored state and is colored by cooling in a decolored state, wherein the heat coloration type reversible thermochromic composition is a heat coloration type reversible thermochromic composition in the form of microcapsules which contains an encapsulated composition comprising three essential components consisting of (a) an electron-donating chromatic organic compound, (b)' an electron-accepting compound selected from gallic acid esters, and (c) a reaction medium having a melting point lower than 50° C. which is selected from alcohols, esters, ketones, and hydrocarbons and which causes color reactions between the two components to occur reversibly at specific temperatures, the heat coloration type composition giving a temperature-color density curve in which the value of ΔH (hysteresis temperature range) is in the range of 3-40° C. and having an average particle diameter of 0.5-50 μm.

(10) The reversible thermochromic display article according to the above (9), wherein the heat coloration type reversible thermochromic composition comprises microcapsules containing at least the three components (a), (b)', and (c) enclosed therein and gives a temperature-color density curve in which the value of AH (hysteresis temperature range) is in the range of 7-40° C.

(11) The reversible thermochromic display article according to the above (9) or (10), wherein the heat coloration type reversible thermochromic composition comprises microcapsules containing enclosed therein at least the three components (a), (b)', and (c) and a fourth component which is (d) a compound selected from monomeric compounds having a melting point of 50° C. or higher and polymeric compounds having a softening point of 70° C. or higher, and gives a temperature-color density curve in which the value of ΔH (hysteresis temperature range) is in the range of 3-25° C.

Figure 1:
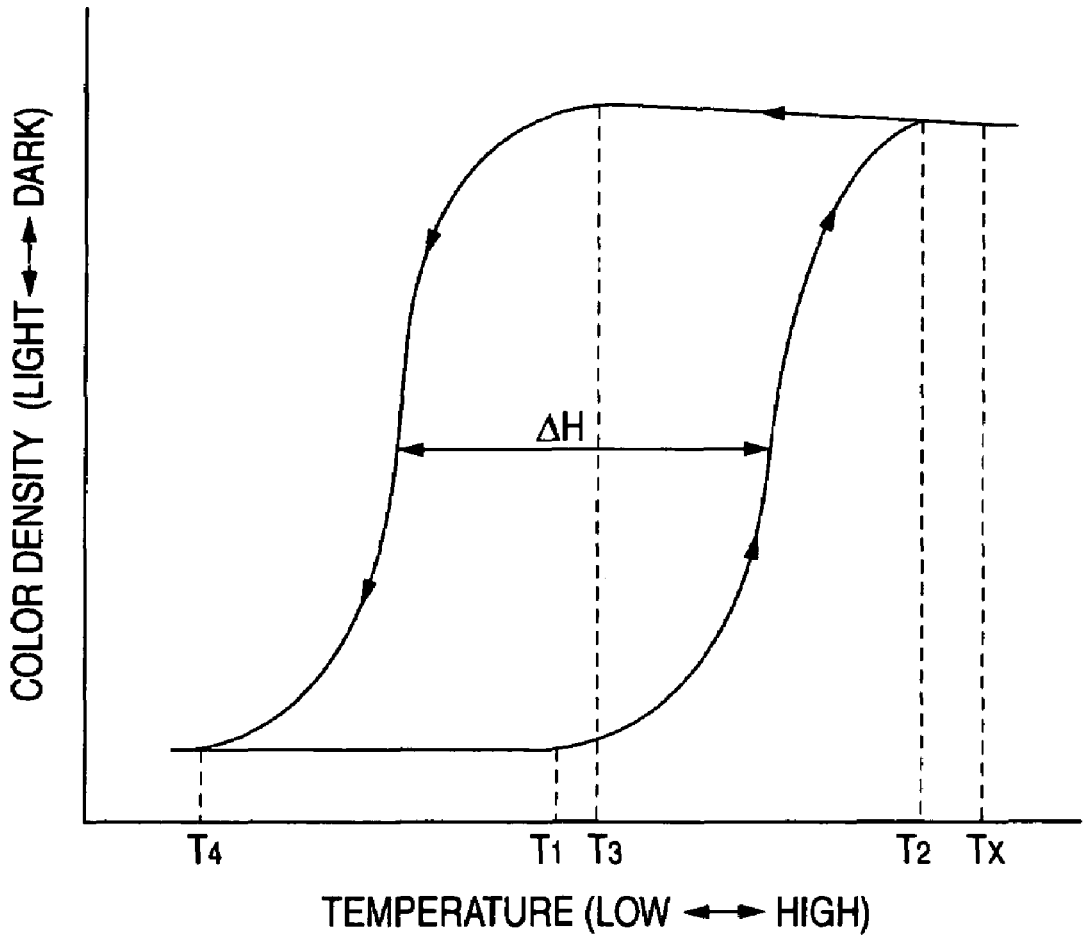
FIG. 1 is a graph showing a temperature-color density curve for a heat coloration type reversible thermochromic composition comprising three components (a), (b)', and (c) which is applied to the invention.

In Figs., sign $T_1$ is a coloration initiation temperature of heat coloration type reversible thermochromic composition, sign $T_2$ is a complete-coloration temperature of heat coloration type reversible thermochromic composition, sign $T_3$ is a decoloration initiation temperature of heat coloration type reversible thermochromic composition, sign $T_4$ is a complete-decoloration temperature of heat coloration type reversible thermochromic composition, sign $T_x$ is a high-temperature region for heat coloration type reversible thermochromic composition, sign $t_1$ is a decoloration initiation temperature of heat decoloration type reversible thermochromic composition, sign $t_2$ is a complete-decoloration temperature of heat decoloration type reversible thermochromic composition, sign $t_3$ is a coloration initiation temperature of heat decoloration type reversible thermochromic composition, sign $t_4$ is a complete-coloration temperature of heat decoloration type reversible thermochromic composition, sign 1 is a reversible thermochromic display article, sign 2 is a substrate, sign 3 is a heat coloration image, and sign 4 is a heat decoloration image.

DETAILED DESCRIPTION OF THE INVENTION

The heat decoloration type reversible thermochromic composition to be used in the invention preferably is any of the reversible thermochromic materials heretofore in general use which are described in U.S. Pat. No. 4,028,118, U.S. Pat. No. 4,732,810, U.S. Pat. No. 4,720,301, etc. Namely, it is preferred to use a composition in the form of microcapsules containing, enclosed therein, a homogeneous compatibilized material comprising the following three components: (a) an electron-donating chromatic organic compound; (b) an electron-accepting compound; and (c) are action medium which determines the temperatures at which color reactions between components (a) and (b) occur.

As the heat coloration type reversible thermochromic composition can be used the heat coloration type reversible thermochromic composition previously proposed by the applicant in US-2003-0122113-A1.

This heat coloration type reversible thermochromic composition is in the form of microcapsules containing, enclosed therein, the following three components: (a) an electron-donating chromatic organic compound; (b)' an electron-accepting compound selected from gallic acid esters; and (c) a reaction medium which determines the temperatures at which color reactions between components (a) and (b)' occur.

Compared to the heat coloration type reversible thermochromic composition employing an alkoxyphenol compound and/or hydroxybenzoic ester compound as component (b)', the heat coloration type reversible thermochromic composition described above has excellent properties such as the following. The composition has a high color density in a colored state. Even when the composition is further heated after a maximum color density has been reached, the color density does not decrease.

In addition, the composition has a high degree of freedom of color change temperature design. Because of such properties, this composition, when used in combination with the heat decoloration type reversible thermochromic composition, gives a reversible thermochromic display article which shows unusual, complicated thermochromic behaviors with an excellent contrast. This display article has a remarkable visual effect rich in the niceties of color changes and in the surprising and magical nature thereof.

Examples of component (a) to be incorporated into the heat coloration type reversible thermochromic composition and heat decoloration type reversible thermochromic composition for use in the invention include known compounds such as diphenylmethane phthalide compounds, phenylindolylphthalide compounds, indolylphthalide compounds, diphenylmethane azaphthalide compounds, phenylindolylazaphthalide compounds, fluoran compounds, styrynoquinoline compounds, and diaza-Rhodamine lactone compounds.

As component (c) also, known compounds such as alcohols, esters, ketones, and hydrocarbons can be used.

Examples of component (b) to be incorporated into the heat decoloration type reversible thermochromic composition include compounds having an active proton, pseudo-acid compounds [compounds which are not an acid but, in the composition, function as an acid to color component (a)], and compounds having an electron hole. Of these, compounds having a phenolic hydroxyl group enable the composition to show most effective thermochromic properties.

Component (b)' to be incorporated into the heat coloration type reversible thermochromic composition is an electron-accepting compound selected from gallic acid esters. Examples thereof include dodecyl gallate, tridecyl gallate, tetradecyl gallate, pentadecyl gallate, hexadecyl gallate, octadecyl gallate, eicosyl gallate, and behenyl gallate. When this component is used in combination with components (a) and (c) described above, the resultant composition is satisfactory in the property of being colored by heating.

The color change behaviors of the heat coloration type reversible thermochromic composition to be used in the invention are explained below.

A homogeneous compatibilized mixture comprising the three components described above, i.e., component (a), a gallic acid ester as component (b)', and component (c), shows the following reversible thermochromic behaviors. When the mixture is heated, it undergoes a transition into a liquid phase and components (a) and (b)' come to be in contact with each other. As a result, the coloring power of component (b)' surpasses the desensitizing power of component (c) to produce a colored state. When this mixture is cooled, component (b)' precipitates and the linkages between component (a) and component (b)' are cleaved, whereby the mixture returns to the decolored state.

The color change behaviors of a heat coloration type reversible thermochromic composition prepared by microencapsulating the mixture of the three components (a), (b)', and (c) are explained below by reference to FIG. 1, which is a presentation showing a color density-temperature curve.

In FIG. 1, temperatures $T_1$, $T_2$, $T_3$, and $T_4$ indicate coloration initiation temperature, complete-coloration temperature, decoloration initiation temperature, and complete-decoloration temperature, respectively.

ΔH, which indicates the difference in temperature between the path from the decolored state to the colored state and the path from the colored state to the decolored state, is calculated using the following equation.

$$\Delta H=(T_2-T_1)/2-(T_3-T_4)/2$$

In the color density-temperature curve, color density changes along the arrows.

At temperatures not higher than $T_1$, the composition is in a decolored state. In a heating process, the composition begins to be colored at the temperature $T_1$ and comes into a completely colored state at the temperature $T_2$. The composition is heated to a temperature exceeding $T_2$. Thereafter, in a cooling process, the composition begins to be decolored when the temperature reaches $T_3$. With further cooling, the color density decreases. The composition is completely decolored when the temperature reaches $T_4$. The value of ΔH (hysteresis temperature range) is in the range of 7-40° C. and is characteristic of the composition. The composition has the property of retaining the colored state even after the heat required for the heating is removed, as long as the temperature thereof is within the range ΔH.

Figure 2:
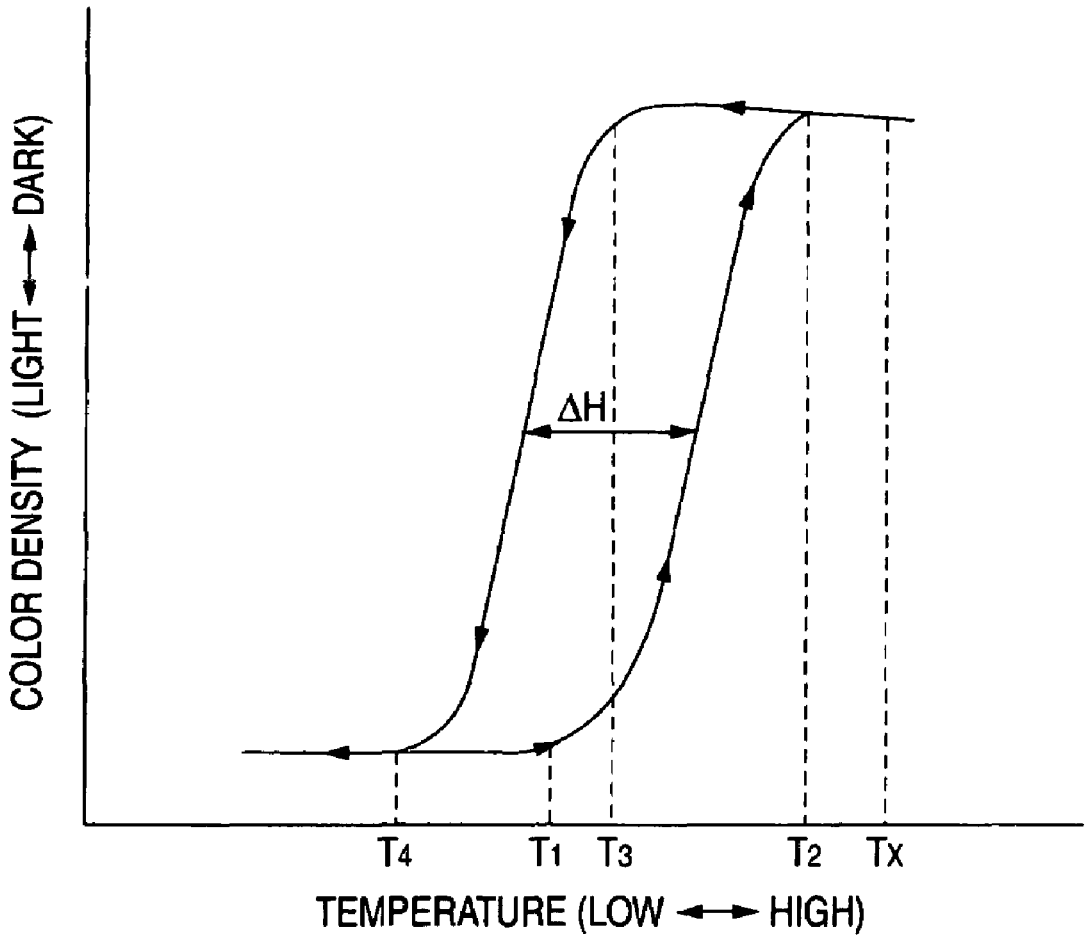
FIG. 2 is a graph showing a temperature-color density curve for a heat coloration type reversible thermochromic composition comprising four components (a), (b)', (c), and (d) which is applied to the invention.

A system obtained by adding (d) a monomeric organic compound having a melting point of 50° C. or higher or a polymeric compound having a softening point of 70° C. or higher as a fourth component to the ternary system described above shows the following color change behaviors (FIG. 2). Component (d) functions to accelerate crystallization in the system and heighten the rate of precipitation of the gallic acid ester (b)' (whitening). Compared to the system not containing component (d), this system has a decoloration initiation temperature ($T_3$) and a complete-decoloration temperature ($T_4$) which have been shifted to the higher-temperature side. This system hence has a reduced value of ΔH, which is in the range of 3-25° C. Namely, the fourth component serves to narrow the temperature range in which a colored state is maintained. Thus, component (d) functions to accelerate return to the original decolored state after coloration with heating means, without the necessity of using special cooling means.

Examples of component (d) are as follows.

Examples of the monomeric organic compound having a melting point of 50° C. or higher are as follows. Preferred examples of fatty acid esters include eicosyl laurate, behenyl laurate, tetracosyl laurate, hexacosyl laurate, octacosyl laurate, cetylmyristate, stearylmyristate, eicosylmyristate, behenyl myristate, teracosyl myristate, hexacosyl myristate, octacosyl myristate, myristyl palmitate, cetyl palmitate, stearyl palmitate, eicosyl palmitate, behenyl palmitate, teracosyl palmitate, hexacosyl palmitate, octacosyl palmitate, cetyl stearate, stearyl stearate, eicosyl stearate, behenyl stearate, tetracosyl stearate, hexacosyl stearate, octacosyl stearate, decyl eicosanoate, undecyl eicosanoate, tridecyl eicosanoate, myristyl eicosanoate, cetyl eicosanoate, stearyl eicosanoate, eicosyl eicosanoate, docosyl eicosanoate, tetracosyl eicosanoate, hexacosyl eicosanoate, octacosyl eicosanoate, methyl behenate, hexyl behenate, octyl behenate, decyl behenate, undecyl behenate, lauryl behenate, tridecyl behenate, myristyl behenate, cetyl behenate, stearyl behenate, eicosyl behenate, behenyl behenate, tetracosyl behenate, hexacosyl behenate, and octacosyl behenate.

Examples of dibasic acid esters include distearyl oxalate, dieicosyl oxalate, behenyl oxalate, distearyl succinate, eicosyl succinate, behenyl succinate, distearyl glutarate, dieicosyl glutarate, behenyl glutarate, dimyristyl adipate, dicetyl adipate, distearyl adipate, eicosyl adipate, behenyl adipate, dicetyl suberate, distearyl suberate, dieicosyl suberate, behenyl suberate, myristyl azelate, dicetyl azelate, distearyl azelate, eicosyl azelate, behenyl azelate, dimyristyl sebacate, dicetyl sebacate, distearyl sebacate, dieicosyl sebacate, dibehenyl sebacate, ditridecyl 1,14-tetradecamethylenedicarboxylate, dimyristyl 1,14-tetradecamethylenedicarboxylate, dicetyl 1,14-tetradecamethylenedicarboxylate, dipalmity 1,14-tetradecamethylenedicarboxylate, distearyl 1,14-tetradecamethylenedicarboxylate, dieicosyl 1,14-tetradecamethylenedicarboxylate, dibehenyl 1,14-tetradecamethylenedicarboxylate, dilauryl 1,16-hexadecamethylenedicarboxylate, ditridecyl 1,16-hexadecamethylenedicarboxylate, dimyristyl 1,16-hexadecamethylenedicarboxylate, dicetyl 1,16-hexadecamethylenedicarboxylate, dipalmityl 1,16-hexadecamethylenedicarboxylate, distearyl 1,16-hexadecamethylenedicarboxylate, dieicosyl 1,16-hexadecamethylenedicarboxylate, dibehenyl 1,16-hexadecamethylenedicarboxylate, didecyl 1,18-octadecamethylenedicarboxylate, dilauryl 1,18-octadecamethylenedicarboxylate, ditridecyl 1,18-octadecamethylenedicarboxylate, dimyristyl 1,18-octadecamethylenedicarboxylate, dicetyl 1,18-octadecamethylenedicarboxylate, dipalmityl 1,18-octadecamethylenedicarboxylate, distearyl 1,18-octadecamethylenedicarboxylate, dieicosyl 1,18-octadecamethylenedicarboxylate, dibehenyl 1,18-octadecamethylenedicarboxylate, didecyl 1,20-eicosylmethylenedicarboxylate, dilauryl 1,20-eicosylmethylenedicarboxylate, ditridecyl 1,20-eicosylmethylenedicarboxylate, dimyristyl 1,20-eicosylmethylenedicarboxylate, dicetyl 1,20-eicosylmethylenedicarboxylate, dipalmityl 1,20-eicosylmethylenedicarboxylate, distearyl 1,20-eicosylmethylenedicarboxylate, dieicosyl 1,20-eicosylmethylenedicarboxylate, dibehenyl 1,20-eicosylmethylenedicarboxylate, trimyristin, tripalmitin, tristearin, trinonadecanoin, cholesterol caproate, cholesterol caprylate, cholesterol caprate, cholesterol undecanoate, cholesterol laurate, cholesterol myristate, cholesterol palmitate, cholesterol stearate, cholesterol eicosanoate, and cholesterol behenate.

Examples of aliphatic ketones, which are preferred among ketones, include dioctyl ketone, dinonyl ketone, diundecyl ketone, ditridecyl ketone, dipentadecyl ketone, diheptadecyl ketone, dinonadecyl ketone, phenyl octyl ketone, phenyl undecyl ketone, phenyl tridecyl ketone, phenyl pentadecyl ketone, and phenyl heptadecyl ketone.

Examples of aliphatic acid amides, which are preferred among acid amides, include hexylamide, heptylamide, octylamide, nonylamide, decylamide, undecylamide, lauramide, tridecylamide, myristamide, palmitamide, stearamide, eicosanamide, behenamide, hexacosanamide, and octacosanamide.

Examples of ethers include pentadecyl ether, dihexadecyl ether, dioctadecyl ether, dieicosyl ether, and didocosyl ether.

Examples of fatty acids include myristic acid, pentadecanoic acid, palmitic acid, heptadecanoic acid, stearic acid, nonadecanoic acid, eicosanoic acid, heneicosanoic acid, behenic acid, tricosanoic acid, lignoceric acid, pentacosanoic acid, cerotic acid, octacosanoic acid, nonacosanoic acid, and melissic acid.

Examples of hydrocarbons include tetracosane, pentacosane, hexacosane, heptacosane, octacosane, nonacosane, triacontane, hentriacontane, dotriacontane, tritriacontane, tetratriacontane, 1-tetracosene, 1-pentacosene, 1-hexacosene, 1-heptacosene, 1-octaconsene, 1-nonacosene, and 1-triacontene.

Examples of the polymeric compound having a softening point of 70° C. or higher include acrylic/aromatic hydrocarbon copolymer resins. Specific examples thereof include acrylic/styrene copolymer resins [Himer SBM100 and Himer SBM73F, both manufactured by Sanyo Chemical Industries, Ltd.].

Figure 3:
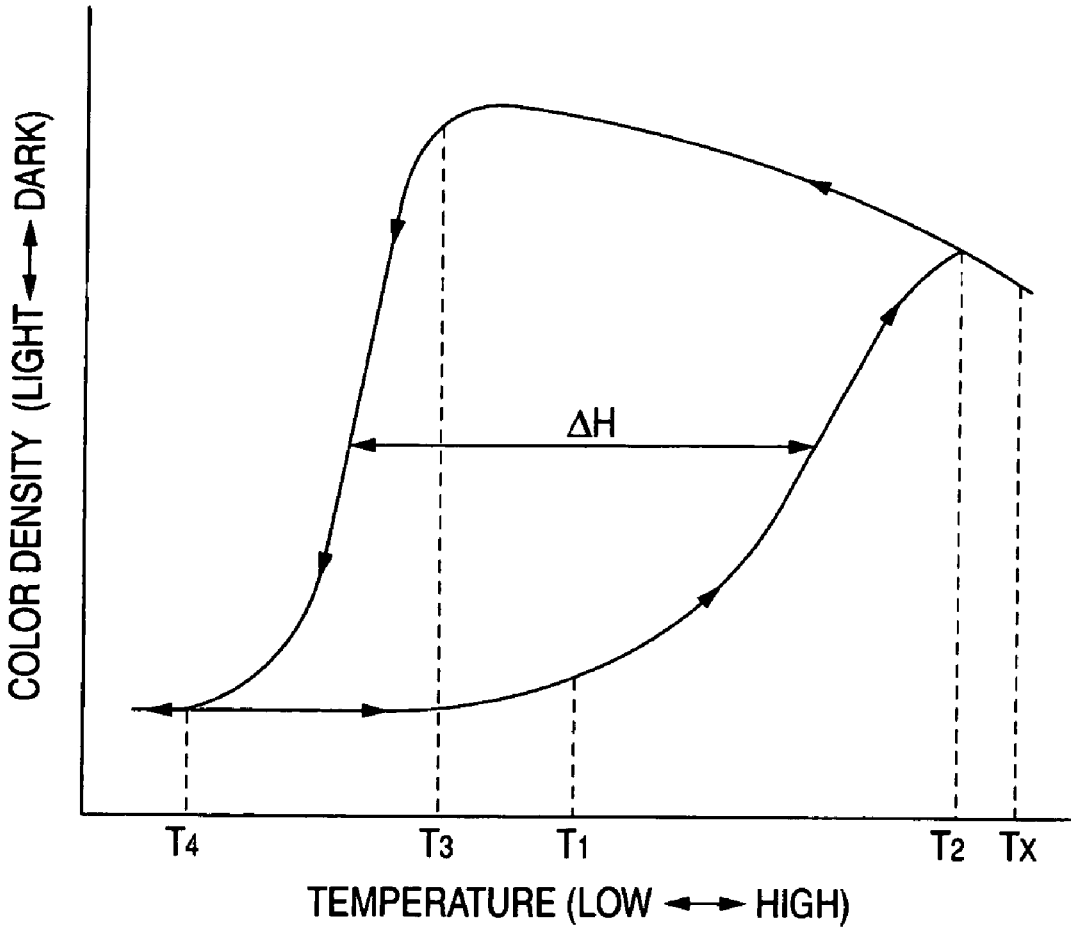
FIG. 3 is a graph showing a temperature-color density curve for an alkoxyphenol-containing heat coloration type reversible thermochromic composition proposed previously.
Figure 4:
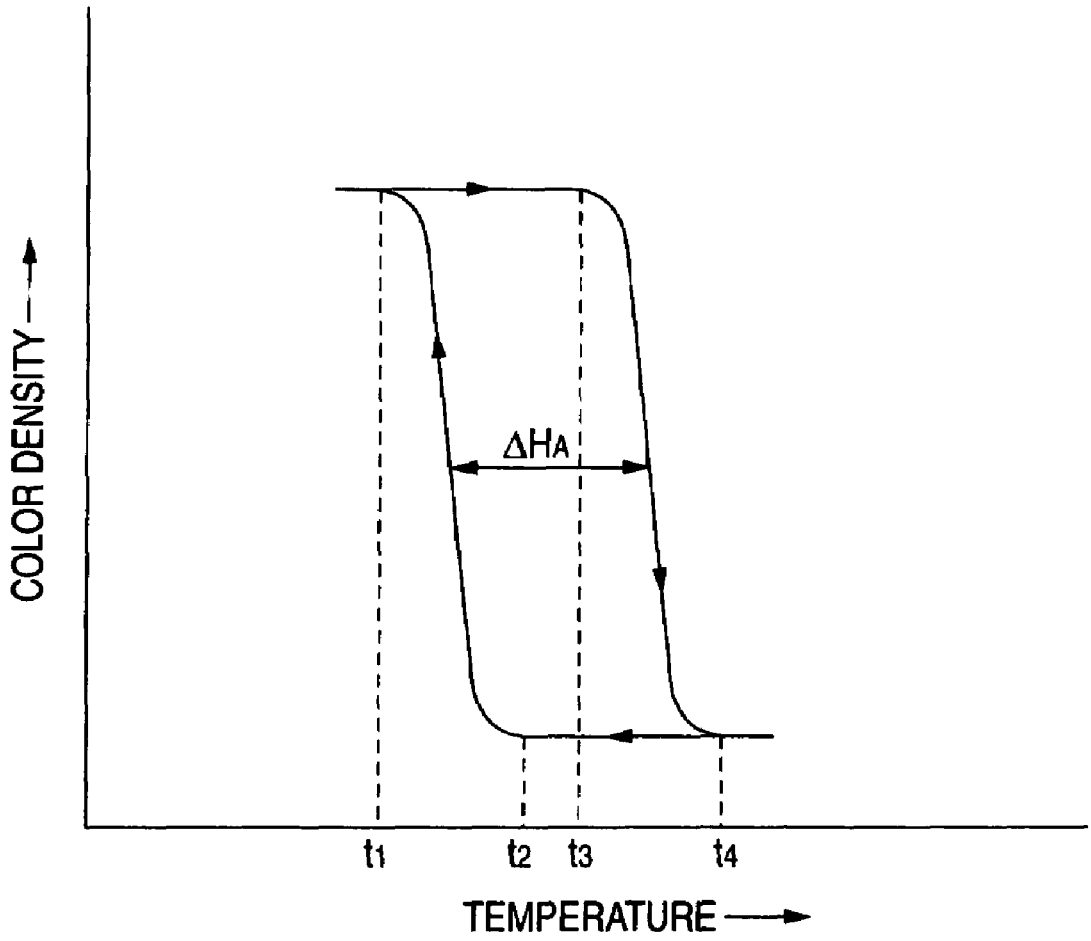
FIG. 4 is a graph showing a temperature-color density curve for a heat decoloration type reversible thermochromic composition comprising three components (a), (b), and (c) which is applied to the invention.

FIG. 3 is a presentation showing a color density-temperature curve for the heat coloration type thermochromic material previously proposed which employs an alkoxyphenol compound and/or hydroxybenzoic ester compound as component (b)'. This material shows color change behaviors in which the color density drops as the temperature increases beyond $T_2$ toward the higher-temperature side ($T_x$), and drops in a lower-temperature range extending to $T_3$. Namely, this chromatic material has a large difference in color density in the coloration temperature range.

In contrast, the heat coloration type reversible thermochromic material employing a gallic acid ester to be used in the invention has an extremely small difference in color density in the coloration temperature range and retains almost the same color density, as shown in FIGS. 1 and 2. In addition, when the material is a system in which $T_1$ is 30-50° C., the value of $T_2$-$T_1$ is smaller than in systems according to related-art techniques and the material shows a coloration behavior with a high color density.

The proportions of the components constituting the heat coloration type reversible thermochromic composition are explained below.

In the ternary system described above, the effective range of the proportion of component (a) is 0.2-20 (preferably 0.5-15) parts by weight and that of component (b)' is 10-80 (preferably 20-70) parts by weight, based on 100 parts by weight of component (c). In the quaternary system described above, the effective range of the proportion of component (d), besides those shown above, is 0.4-20 (preferably 1-10) parts by weight.

In case where the amount of component (b)' is smaller than 10 part by weight, based of 100 parts by weight of component (c), the color density of the system in the state of being colored by heating is practically insufficient. On the other hand, in case where the amount thereof exceeds 80 parts by weight, component (b)' is present in excess and this is apt to impair the reversibility of dissolution-precipitation in component (c). This system is hence less apt to have the property of being reversibly colored and decolored and further has poor sharpness in decoloration.

In case where the amount of component (d) is smaller than 0.4 parts by weight, based on 100 parts by weight of component (c), the effect of shifting a lower-temperature-side color change curve to the higher-temperature side is insufficient. On the other hand, in case where the amount thereof exceeds 20 parts by weight, the system has a poor balance between coloration and decoloration.

Although component (c) may consist of one of the compounds shown above, it is effective to use a combination of an alcohol and an ester or a combination of an alcohol and a hydrocarbon. An explanation is given below on this point.

In an encapsulated composition consisting of the four components described above, changes in the state of the gallic acid ester (b)', i.e., the state of being dissolved in heating (at high temperatures) and the state of being precipitated in cooling (at low temperatures), are influenced by the chemical and physical properties of component (c).

Especially in alcohols, the alcohols function to weaken the coloring power of the gallic acid ester (b)'. Namely, the desensitizing power of the alcohols is more exhibited than the coloring power. Alcohols hence have the property of reducing the color density of the encapsulated composition.

On the other hand, an ester-containing system has the following properties. When the gallic acid ester (b)' is in a dissolved state in heating (at high temperatures), the ester as a reaction medium has a lower desensitizing power than alcohols and less influences the coloring power of the gallic acid ester (b)'. This system hence has a satisfactory color density in a colored state. In cooling (at low temperatures), however, the gallic acid ester (b)' is less apt to precipitate and the system is hence less apt to come into a decolored state. By combining the properties of an alcohol with the properties of an ester so as to well balance these, both of a satisfactory colored state in heating (at high temperatures) and a decolored state in cooling (at low temperatures) are effectively attained.

In the system which employs an alcohol and an ester in combination, the proportion of the alcohol to the ester is from 80/20 to 20/80 [preferably from 70/30 to 30/70, more preferably from 60/40 to 40/60 (by weight)].

The system containing a hydrocarbon has a higher color density than the system employing an ester. The proportion of an alcohol to a hydrocarbon is from 80/20 to 20/80 [preferably from 70/30 to 30/70, more preferably from 60/40 to 40/60 (by weight)].

The heat decoloration type reversible thermochromic composition is obtained by microencapsulating the three components (a), (b), and (c), while the heat coloration type reversible thermochromic composition is obtained by microencapsulating the three components (a), (b)', and (c) or the four components (a), (b)', (c), and (d).

For the microencapsulation may be used a known method suitably selected from interfacial polymerization, in-situ polymerization, in-liquid curing coating, phase separation from an aqueous solution, phase separation from an organic solvent, melt dispersion cooling, air-suspension coating, spray drying, and the like. It is possible to form a secondary resin coating film on the surface of the microcapsules to thereby improve durability or modify the surface properties, before the microcapsules are subjected to practical use.

It is a matter of course that since the composition produced is in the form of microcapsules, the functions of the composition do not decrease even when the composition comes into contact with chemically active substances such as acid substances, basic substances, and peroxides or with solvent components. The composition can further retain thermal stability. Because of these, the reversible thermochromic composition can retain the same makeup and produce the same effects under a variety of use conditions.

The microcapsules have a circular or non-circular cross section. The average particle diameter thereof is in the range of 0.5-50 μm, preferably 1-30 μm, more preferably 3-20 μm, from the standpoint of suitability for practical use.

In case where the average particle diameter of the microcapsules exceeds 50 μm, the microcapsules have poor dispersion stability and poor suitability for processing in application to inks, coating materials, or the like.

On the other hand, in case where the average particle diameter thereof is smaller than 0.5 μm, the microcapsules are less apt to be colored in a high concentration.

The heat coloration image and heat decoloration image in the invention each are a thermochromic image which comprises the heat coloration type reversible thermochromic composition or heat decoloration type reversible thermochromic composition, respectively, and a binder resin in which the composition is dispersed and fixed. These images are formed on a substrate by a technique such as printing or coating.

In the case where the heat coloration image and heat decoloration image have been superposed in such a manner that the heat decoloration image partly overlies the heat coloration image, the ratio of the are a of that part of the heat decoloration image in which this image has been formed to the area of that part of the heat decoloration image in which this image has not been formed is preferably from 20:80 to 99:1 per $cm^2$.

This constitution is intended not only to enable the shape of the image formed by the slight residual color of the heat coloration image in a decolored state to be less recognized, but also to impart freedom of color tone selection to the heat decoloration image.

As stated above, it is possible to hide the underlying heat coloration image by forming a heat decoloration image having a dark color or by thickly forming a heat decoloration image. However, the color tone of the heat decoloration image in a colored state is limited to dark colors and it is difficult to satisfy marketability, while the formation of a thick heat decoloration image results in impaired productivity.

The ratio of the are a of that part of the heat decoloration image in which this image has been formed to the are a of that part of the heat decoloration image in which this image has not been formed is regulated to preferably from 20:80 to 99:1 per $cm^2$, more preferably 30:70 to 95:5 per $cm^2$. Even when the residual color of the heat coloration image in a decolored state is recognized through that part of the heat decoloration image in which this image has not been formed, the constitution described above enables the shape of the heat coloration image itself to be less recognized.

In case where the requirement concerning areal ratio is not satisfied, the shape of the heat coloration image itself is easily recognized. Namely, the following is thought. In case where the are a of the part in which the heat decoloration image has been formed is small, the shape of the heat coloration image is easily recognized. In contrast, since the overlying heat decoloration image in the invention has a cutout pattern formed therein, the attention of the person watching the reversible thermochromic display article is attracted to the cutout pattern and, hence, the underlying heat coloration image is less recognized.

On the other hand, in case where the are a of the part in which the heat decoloration image has been formed is large, the point at which the eyes of the person are turned shifts to the shape of the heat coloration image through the heat decoloration image and, hence, the underlying heat coloration image is more recognized.

It is preferred that the heat decoloration image in a colored state have a lightness of 4.0 or higher. When the lightness of the image is 4.0 or higher, a change in state is clearly recognized.

The heat coloration layer and the heat decoloration layer can be formed by the following methods. A heat coloration layer is formed from a dispersion of a heat coloration type reversible thermochromic composition in a thermoplastic resin or thermosetting resin, and a heat decoloration layer is formed thereon using an ink containing a heat decoloration type reversible thermochromic composition by a technique such as printing or coating. Alternatively, a heat decoloration layer is formed from a dispersion of a heat decoloration type reversible thermochromic composition in a thermoplastic resin or thermosetting resin, and a heat coloration layer is formed thereon using an ink containing a heat coloration type reversible thermochromic composition by a technique such as printing or coating. Furthermore, use may be made of a method in which a heat coloration layer formed from a dispersion of a heat coloration type reversible thermochromic composition in a thermoplastic resin or thermosetting resin and a heat decoloration layer formed from a dispersion of a heat decoloration type reversible thermochromic composition in a thermoplastic resin or thermosetting resin are bonded to constitute a reversible thermochromic display article.

The makeups of the encapsulated compositions of the reversible thermochromic compositions to be used in Examples according to the invention and Comparative Examples are shown in the following tables.

TABLE 1

| Reversible thermochromic composition | | Components | Parts by weight |
|---|---|---|---|
| a | (a) | 2-(dibutylamino)-8-(dipentylamino)-4-methylspiro[5H-[1]-benzopyrano-[2,3-g]pyrimidine-5,1'(3H)-isobenzofuran]-3-one | 1.0 |
| | (b)' | dodecyl gallate | 8.0 |
| | (c) | n-heptyl stearate | 10.0 |
| | | myristyl alcohol | 15.0 |
| b | (a) | 2-(dibutylamino)-8-(dipentylamino)-4-methylspiro[5H-[1]-benzopyrano-[2,3-g]pyrimidine-5,1'(3H)-isobenzofuran]-3-one | 1.0 |
| | (b)' | dodecyl gallate | 8.0 |
| | (c) | stearyl laurate | 12.5 |
| | | lauryl alcohol | 12.5 |
| c | (a) | 6'-[ethyl(4-methylphenyl)amino]-2'-(methylphenylamino)spiro-[isobenzofuran-1(3H),9'-(9H)xanthen]-3-one | 4.5 |
| | (b)' | dodecyl gallate | 8.0 |
| | (c) | cetyl caprate | 12.5 |
| | | myristyl alcohol | 12.5 |
| | (d) | behenyl behenate | 1.0 |
| d | (a) | 3-[2-ethoxy-4-(N-ethylanilino)-phenyl]-3-(1-ethyl-2-methyl-3-indolyl)-4-azaphthalide | 2.0 |
| | (b)' | stearyl gallate | 10.0 |
| | (c) | stearyl caprate | 8.75 |
| | | n-docosane | 8.75 |
| | | lauryl alcohol | 7.5 |
| | (d) | octadecyl ether | 1.0 |

TABLE 2

| Reversible thermochromic composition | | Components | Parts by weight |
|---|---|---|---|
| e | (a) | 1,2-benz-6-(N-ethyl-N-isobutyl-amino)fluoran | 1.5 |
| | (b)' | p-n-hexyloxyphenol | 3.0 |
| | | p-n-octyloxyphenol | 7.0 |
| | (c) | n-eicosane | 30.0 |
| f | (a) | 3-[2-ethoxy-4-(N-ethylanilino)-phenyl]-3-(1-ethyl-2-methyl-3-indolyl)-4-azaphthalide | 1.5 |
| | (b)' | p-n-decyloxyphenol | 10.0 |
| | (c) | n-docosane | 30.0 |

TABLE 3

| Reversible thermochromic composition | | Components | Parts by weight |
|---|---|---|---|
| g | (a) | 3-[2-ethoxy-4-(N-ethylanilino)-phenyl]-3-(1-ethyl-2-methyl-3-indolyl)-4-azaphthalide | 1.5 |
| | (b) | 1,1-bis(4-hydroxyphenyl)-2-methypropane | 6.0 |
| | (c) | n-undecyl laurate | 50.0 |
| h | (a) | 1,3-dimethyl-6-diethylamino-fluoran | 1.5 |
| | (b) | 1,1-bis(4-hydroxyphenyl)-2-methylpropane | 6.0 |
| | (c) | cetyl alcohol | 25.0 |
| | | stearyl laurate | 25.0 |
| i | (a) | 1,2-benz-6-(N-ethyl-N-isobutyl-amino)fluoran | 1.5 |
| | (b) | 1,1-bis(4-hydroxyphenyl)-2-methylpropane | 6.0 |
| | (c) | cetyl alcohol | 25.0 |
| | | stearyl laurate | 25.0 |
| j | (a) | 3-[2-ethoxy-4-(N-ethylanilino)-phenyl]-3-(1-ethyl-2-methyl)-3-indolyl)-4-azaphthalide | 1.5 |
| | (b) | 1,1-bis(4-hydroxyphenyl)-2-methylpropane | 6.0 |
| | (c) | stearyl alcohol | 25.0 |
| | | stearyl laurate | 25.0 |
| k | (a) | 3-[2-ethoxy-4-(N-ethylanilino)-phenyl]-3-(1-ethyl-2-methyl-3-indolyl)-4-azaphthalide | 1.5 |
| | (b) | 1,1-bis(4-hydroxyphenyl)-n-octane | 7.0 |
| | (c) | cetyl caprate | 45.0 |
| | | stearyl laurate | 5.0 |

The reversible thermochromic compositions shown in Table 1 are the encapsulated compositions of gallic acid ester-containing heat coloration type reversible thermochromic compositions for use in constituting reversible thermochromic display article of the invention. Table 2 sign shows the makeups of the encapsulated compositions of alkoxyphenol-containing heat coloration type reversible thermochromic compositions proposed previously. Table 3 shows the makeups of the encapsulated compositions of heat decoloration type reversible thermochromic compositions for use in the invention.

The color change temperatures of each reversible thermochromic composition, the hysteresis range (ΔH value) in a temperature-color density curve for the composition, etc. are shown in the following table.

TABLE 4

| Reversible thermochromic composition | Color changes | Color change temperatures (° C.) $T_1$ | $T_2$ | $T_3$ | $T_4$ | ΔH (° C.) |
|---|---|---|---|---|---|---|
| a | pink ↔ colorless | 30 | 40 | 16 | 8 | 23 |
| b | pink ↔ colorless | 28 | 43 | 32 | 24 | 8 |
| c | green ↔ colorless | 34 | 43 | 36 | 24 | 11 |
| d | blue ↔ colorless | 44 | 60 | 34 | 30 | 20 |
| e | pink ↔ colorless | 30 | 40 | 27 | 20 | 13 |
| f | blue ↔ colorless | 45 | 60 | 35 | 28 | 14 |
| g | blue ↔ colorless | 28 | 34 | 14 | 8 | 20 |
| h | orange ↔ colorless | 30 | 35 | 31 | 28 | 3 |
| i | pink ↔ colorless | 30 | 36 | 29 | 27 | 5 |
| j | blue ↔ colorless | 37 | 41 | 35 | 33 | 5 |
| k | blue ↔ colorless | 29 | 36 | 32 | 27 | 3 |

For the heat coloration type reversible thermochromic compositions (reversible thermochromic compositions a to f), the temperatures $T_1$, $T_2$, $T_3$, and $T_4$ indicate coloration initiation temperature, complete-coloration temperature, decoloration initiation temperature, and complete-decoloration temperature, respectively. For the heat decoloration type reversible thermochromic compositions (reversible thermochromic compositions g to k), temperatures $t_1$, $t_2$, $t_3$, and $t_4$ indicate decoloration initiation temperature, complete-decoloration temperature, coloration initiation temperature, and complete-coloration temperature.

Examples of the invention will be given below. In the following Examples, all "parts" used for showing ink make-ups are "parts by weight".

EXAMPLES

Each of reversible thermochromic compositions a to f and k was microencapsulated with a wall material consisting of a urea resin obtained by reacting an aromatic isocyanate prepolymer with water. Thus, reversible thermochromic compositions A to F and K were prepared.

Each of reversible thermochromic compositions g to j was microencapsulated with an epoxy wall material obtained by epoxy-amine interfacial polymerization. Thus, reversible thermochromic compositions G to J were prepared.

Example 1

40 parts of heat coloration type reversible thermochromic composition A was evenly dispersed in a vehicle comprising 50 parts of an ethylene/vinyl acetate copolymer resin emulsion, 3 parts of an antifoamer, 1 part of a thickener, and 3 parts of a leveling agent to obtain a heat coloration type reversible thermochromic screen ink.

Furthermore, 40 parts of heat decoloration type reversible thermochromic composition G was used according to the same formulation as shown above to obtain a heat decoloration type reversible thermochromic screen ink.

Production of Reversible Thermochromic Display Article:

The heat coloration type reversible thermochromic screen ink was used to form a flower pattern (heat coloration image A) on white wood-free paper by line drawing. Subsequently, the heat decoloration type reversible thermochromic screen ink was used to form a butterfly pattern (heat decoloration image G) on the heat coloration image A by line drawing. Thus, a reversible thermochromic card was produced.

When the reversible thermochromic card was heated, the butterfly pattern (heat decoloration image G) disappeared at 33° C. or above and, simultaneously therewith, the flower pattern (heat coloration image A) began to be colored. At the time when the card was further heated to 40° C., the flower pattern of a deep pink color appeared clearly. This reversible thermochromic card was allowed to cool naturally by standing at room temperature. As a result, the colored state of the flower pattern (heat coloration image A) was maintained until the temperature reaches 25° C. Subsequently, a cooling device was used to cool the card. At 10° C., the flower pattern began to disappear and, simultaneously therewith, the blue butterfly pattern (heat decoloration image G) began to be colored. When the temperature of the card reached 8° C. or lower, the butterfly pattern was clearly recognized. The device for cooling the card was removed and the card was allowed to stand. As a result, the butterfly pattern was maintained at room temperature, i.e., 25° C. This reversible thermochromic card is a thermochromic color-memorizing card which can be made at will to alternately retain either of the flower pattern and the butterfly pattern in an ordinary-temperature region. The appearance changes with temperature described above could be repeatedly produced.

Example 2

30 parts of heat coloration type reversible thermochromic composition B was evenly dispersed in a vehicle comprising 50 parts of an ethylene/vinyl acetate copolymer resin, 3 parts of an antifoamer, 1 part of a thickener, 3 parts of a leveling agent, and 1 part of an antiseptic to obtain a heat coloration type reversible thermochromic screen ink.

Furthermore, heat decoloration type reversible thermochromic composition H was used to obtain a heat decoloration type reversible thermochromic screen ink in the same manner as described above.

Production of Reversible Thermochromic Display Article:

The heat coloration type reversible thermochromic screen ink was used to print "the face of a girl" (heat coloration image B) on a translucent substrate (sheet) made of a flexible vinyl chloride resin. Subsequently, the heat decoloration type reversible thermochromic screen ink was used to print "the face of a boy" (heat decoloration image H) on the printed substrate. Furthermore, solid printing was conducted thereon using a general white ink. Thus, a layered product was formed.

The layered product was held so that the translucent-substrate side faced downward. A urethane foam sheet having a thickness of 5 mm and a translucent sheet which was the same as the substrate were placed on the while solid print part. That part of the resultant assemblage which surrounded the periphery of the general white ink at a distance of 1 cm therefrom was subjected to high-frequency welding. Thereafter, the unnecessary parts were removed to thereby obtain a reversible thermochromic picture book for bathing.

When the picture book for bathing was allowed to stand at room temperature of 25° C., "the boy's face" of an orange color (heat decoloration image H) was visible. However, when the picture book was placed in warm water of 40° C. or higher, "the boy's face" of an orange color (heat decoloration image H) disappeared and, simultaneously therewith, "the girl's face" of a pink color (heat coloration image B) appeared. When this picture book was subsequently taken out of the warm water and put in 25° C. water, "the girl's face" of a pink color (heat coloration image B) disappeared and "the boy's face" (heat decoloration image H) appeared again.

The appearance changes with temperature described above could be repeatedly produced.

Example 3

15 parts of heat coloration type reversible thermochromic composition C which had been dried was mixed, with stirring, with a vehicle comprising 40 parts of a xylene solution of an acrylic resin, 3 parts of an ultraviolet absorber, 30 parts of xylene, 30 parts of methyl isobutyl ketone, and 10 parts of a hexamethylene diisocyanate hardener to obtain a heat coloration type reversible thermochromic spray coating material.

Furthermore, heat decoloration type reversible thermochromic composition I was used to obtain a heat decoloration type reversible thermochromic spray coating material in the same manner as described above.

Production of Reversible Thermochromic Display Article:

The heat coloration type reversible thermochromic spray coating material was charged into a spray gun. The whole body of a miniature car obtained by injection-molding a mixture of an ABS resin and white master pellets was coated with the coating material and dried.

Subsequently, the heat decoloration type reversible thermochromic spray coating material was charged into a spray gun and applied to the hood of the miniature car to form a star mark (heat decoloration image I). The coating was dried to obtain a reversible thermochromic miniature car.

At room temperature of 25° C., the miniature car was wholly white, except that the hood only had the star mark of a pink color (heat decoloration image I). When this miniature car was put in 42° C. warm water and heated to 35° C. or higher, the pink star mark (heat decoloration image I) disappeared. When the temperature thereof further rose and exceeded 40° C., the body wholly assumed a green color. Subsequently, the body was taken out of the warm water. As the temperature thereof declined to 30° C. or lower, the green color of the body gradually became light. At the time when the temperature thereof reached 25° C. or lower, the whole body was nearly white and the pink star mark (heat decoloration image I) appeared in the hood.

The appearance changes with temperature described above could be repeatedly produced.

Example 4

30 parts of heat coloration type reversible thermochromic composition D which had been dried was evenly dispersed, with kneading, in a vehicle comprising 60 parts of a rigid epoxy resin, 2 parts of an ultraviolet absorber 2 parts of a thixotropic agent, and 1 part of an antifoamer. Thereto was added 35 parts of a cold-setting aliphatic polyamine. The polyamine was evenly dispersed to obtain a heat coloration type reversible thermochromic epoxy ink.

Furthermore, heat decoloration type reversible thermochromic composition J was used to obtain a heat decoloration type reversible thermochromic epoxy ink by the same method as described above.

Production of Reversible Thermochromic Display Article:

A non-thermochromic blue epoxy ink was used to print a nearly lower half of an egg pattern on the side wall of a china mug with a cylindrical printer. The ink applied was cured by heating at 70° C. for 1 hour to form a non-thermochromic image.

Subsequently, the heat coloration type reversible thermochromic epoxy ink was used to print the upper half of a dinosaurian body on the part corresponding to the upper half of the egg pattern. The ink applied was cured by heating at 70° C. for 1 hour to form a heat coloration image D1. Furthermore, the heat coloration type reversible thermochromic epoxy ink D was used to print part of a pattern of a broken upper half of an eggshell on both sides of the dinosaur pattern, and the ink applied was cured by heating at 70° C. for 1 hour to obtain a heat coloration image D2. Subsequently, the heat decoloration type reversible thermochromic epoxy ink was used to print the upper half of the egg pattern so that this upper half overlay the pattern of the upper half of a dinosaurian body (heat coloration image D1). The ink applied was cured by heating at 70° C. for 1 hour to form a heat decoloration image J. Thus, a reversible thermochromic mug was obtained.

When the reversible thermochromic mug was placed in a room-temperature atmosphere, neither the heat coloration image D1 nor the heat coloration image D2 was visible, and an egg pattern consisting of the non-thermochromic image and the heat decoloration image J was visible.

When 80° C. hot water was poured into the mug, the heat decoloration image J was decolored and the heat coloration image D1 and the heat coloration image D2 were colored. Because of this, an image appeared which showed an eggshell whose upper half had broken and a dinosaur which had hatched out. Subsequently, the hot water was removed and the mug was allowed to cool naturally in a room-temperature atmosphere. As a result, the mug gradually returned to the original appearance.

The appearance changes with temperature described above could be repeatedly produced.

Example 5

40 parts of heat coloration type reversible thermochromic composition B was evenly dispersed in a vehicle comprising 56 parts of an aqueous urethane dispersion, 3 parts of an antifoamer, and 1 part of a thickener to obtain a heat coloration type reversible thermochromic screen ink.

Furthermore, 40 parts of heat decoloration type reversible thermochromic composition H was used according to the same formulation as shown above to obtain a heat decoloration type reversible thermochromic screen ink.

Production of Reversible Thermochromic Display Article:

The heat coloration type reversible thermochromic screen ink was used to print an image of 4×6 cm size on a white synthetic paper with 180-mesh screen printing plate to form a heat coloration image B.

Subsequently, the heat decoloration type reversible thermochromic screen ink was used to print the same image thereon in the same position using the same screen printing plate to form a heat decoloration image H.

Furthermore, a laminating film (20 μm) made of polypropylene was laminated to the upper side of the printed synthetic paper. That part of the resultant laminate which included the printed are a and was larger than the are a by 5 mm from each side was cut out. Thus, a reversible thermochromic card was produced.

At room temperature of 25° C., the card had an orange color attributable to the heat decoloration image H. The surface of this card was strongly rubbed with a finger. As a result, the orange color attributable to the heat decoloration image H disappeared in the rubbed part and, simultaneously therewith, the heat coloration image B assumed a dark pink color.

The card in this state was allowed to stand at room temperature. As a result, the pink color disappeared in a few minutes and the card returned to the orange color.

With respect to the color of the heated card in a colored state, among the appearance changes described above, only the color of the heat coloration type reversible thermochromic composition was recognized, and the heat decoloration type reversible thermochromic composition did not influence the pink color of the card in the colored state because this composition was in a decolored state. With respect to the color of the cooled card in a colored state, only the color of the heat decoloration type reversible thermochromic composition was recognized, and the heat coloration type reversible thermochromic composition did not influence the orange color of the card in the colored state because this composition was in a decolored state.

Example 6

40 parts of heat coloration type reversible thermochromic composition B was evenly dispersed in a vehicle comprising 56 parts of an aqueous urethane dispersion, 3 parts of an antifoamer, and 1 part of a thickener to obtain a heat coloration type reversible thermochromic screen ink.

Furthermore, 40 parts of heat decoloration type reversible thermochromic composition K was used according to the same formulation as shown above to obtain a heat decoloration type reversible thermochromic screen ink.

Production of Reversible Thermochromic Display Article:

The heat decoloration type reversible thermochromic screen ink was used to print an apple pattern with 180-mesh screen printing plate on the surface of a label made of a white synthetic paper and having a pressure-sensitive adhesive layer and a release paper on the back side thereof. Thus, a heat decoloration image K was formed.

Subsequently, the heat coloration type reversible thermochromic screen ink was used to print the same pattern thereon in the same position using the same screen printing plate to form a heat coloration image B.

Furthermore, a laminating film (20 μm) made of polypropylene was laminated to the upper side of the printed label. That part of the resultant laminate which included the printed are a and was larger than the are a by 5 mm from each side was cut out. Thus, a reversible thermochromic label was produced.

The release paper of the label was stripped off and the label was applied to the side wall of a white plastic cup.

When this cup was allowed to stand at room temperature, a blue apple pattern attributable to the heat decoloration image K was recognized. When hot water was poured into the cup, the blue color of the heat decoloration image K disappeared and the heat coloration image B was colored to make the apple pattern pink.

The hot water was removed and the cup was allowed to stand at room temperature for a few minutes. As a result, the apple pattern returned to the blue color again.

With respect to the color of the heated pattern in a colored state, among the appearance changes described above, only the color of the heat coloration type reversible thermochromic composition was recognized, and the heat decoloration type reversible thermochromic composition did not influence the pink color of the pattern in the colored state because this composition was in a decolored state. With respect to the color of the cooled pattern in a colored state, only the color of the heat decoloration type reversible thermochromic composition was recognized, and the heat coloration type reversible thermochromic composition did not influence the blue color of the pattern in the colored state because this composition was in a decolored state.

Example 7

Using an extruder, 20 parts of heat decoloration type reversible thermochromic composition K, 5 parts of a dispersant, 1 part of a white pigment, and 974 parts of a styrene/synthetic rubber copolymer resin were melt-mixed together at 170° C. to obtain pellets.

The pellets were molded into a miniature car body (heat decoloration layer K) with an injection molding machine.

Subsequently, 15 parts of heat decoloration type reversible thermochromic composition B was mixed, with stirring, with a vehicle comprising 40 parts of a xylene solution of an acrylic resin, 3 parts of an ultraviolet absorber, 30 parts of xylene, 30 parts of methyl isobutyl ketone, and 10 parts of a hexamethylene diisocyanate hardener to obtain a heat coloration type reversible thermochromic spray coating material.

Production of Reversible Thermochromic Display Article:

The heat coloration type reversible thermochromic spray coating material was charged into a spray gun and applied to the whole miniature car body. Thereafter, the coating was dried to form a heat coloration layer B.

At 27° C. or lower, the miniature car had a blue color (sky blue) attributable to the heat decoloration layer K. Upon immersion in warm water of 35° C. or higher, the blue color of the heat decoloration layer K disappeared and the overlying heat coloration layer B was colored in pink.

Subsequently, the miniature car was taken out of the warm water and allowed to stand at room temperature. As a result, the pink color attributable to the heat coloration layer B gradually disappeared and the heat decoloration layer K was colored. The miniature car thus returned to the blue color.

With respect to the color of the heated miniature car in a colored state, among the appearance changes described above, only the color of the heat coloration type reversible thermochromic composition was recognized, and the heat decoloration type reversible thermochromic composition did not influence the pink color of the miniature car in the colored state because this composition was in a decolored state. With respect to the color of the cooled miniature car in a colored state, only the color of the heat decoloration type reversible thermochromic composition was recognized, and the heat coloration type reversible thermochromic composition exerted almost no influence on the blue color of the miniature car in the colored state because this composition was in a decolored state.

Example 8

Figure 5:
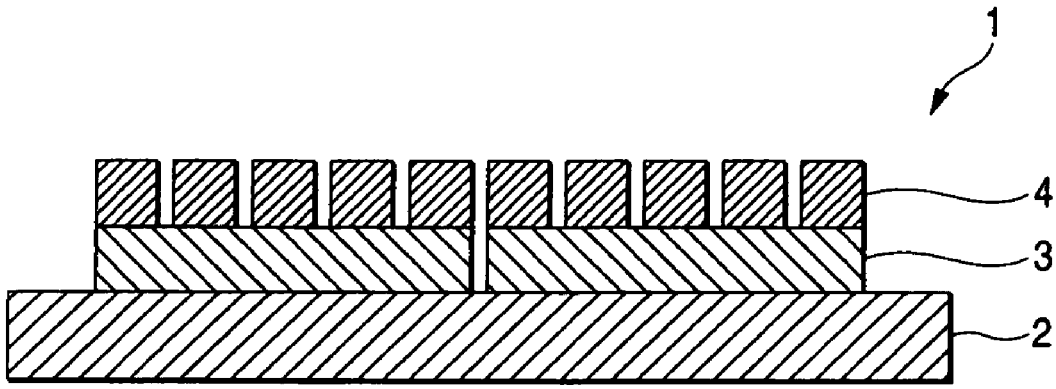
FIG. 5 is a vertical sectional view of one embodiment of the reversible thermochromic display article of the invention.
Figure 6:
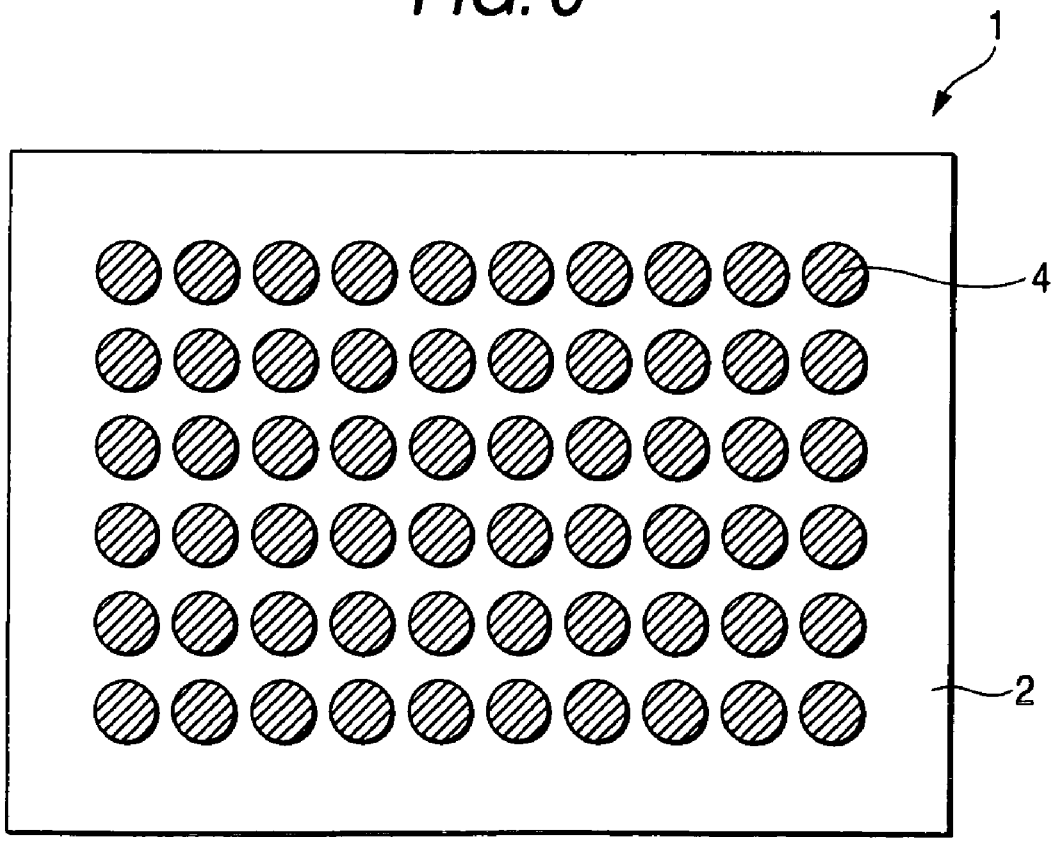
FIG. 6 is a front view illustrating the reversible thermochromic display article of FIG. 5 in which the heat decoloration image is in a colored state and the heat coloration image is in a decolored state.
Figure 7:
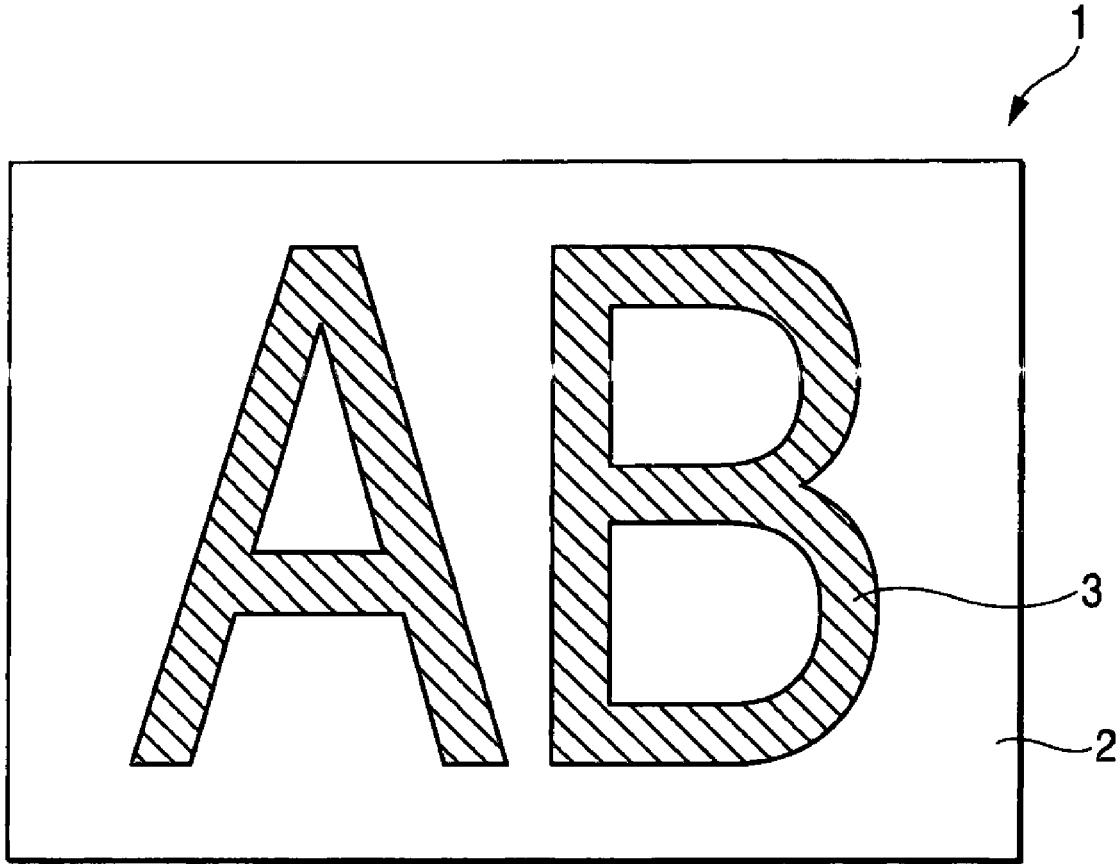
FIG. 7 is a front view illustrating the reversible thermochromic display article of FIG. 5 in which the heat decoloration image is in a decolored state and the heat coloration image is in a colored state.

See FIGS. 5, 6, and 7

Preparation of Heat Coloration Type Reversible Thermochromic Screen Ink

A heat coloration type reversible thermochromic screen ink was prepared by mixing 40.0 parts of heat coloration type reversible thermochromic composition C with 50.0 parts of a urethane emulsion, 3.0 parts of an antifoamer, 1.0 part of a thickener, and 3.0 parts of a leveling agent.

Subsequently, 40.0 parts of heat decoloration type reversible thermochromic composition H was mixed with 50.0 parts of an ethylene/vinyl acetate resin emulsion, 3.0 parts of an antifoamer, 1.0 part of a thickener, and 3.0 parts of a leveling agent to prepare a heat decoloration type reversible thermochromic screen ink.

The heat decoloration type reversible thermochromic ink was used to conduct printing on wood-free paper with a 180-mesh screen printing plate. Thereafter, the lightness of the printed paper in a colored state was measured with a color difference meter [Type TC-3600, manufactured by Tokyo Denshoku Co., Ltd.]. As a result, the lightness thereof was found to be 6.5.

Production of Reversible Thermochromic Display Article:

The heat coloration type reversible thermochromic screen ink was used to print the characters "AB" on wood-free paper as a substrate 2 with 150-mesh screen printing plate to form a heat coloration image 3.

Subsequently, the heat decoloration type reversible thermochromic screen ink was used to conduct printing on the heat coloration image 3 with 120-mesh screen printing plate having a cutout pattern consisting of regularly arranged dots with a diameter of 1 mm. Thus, a heat decoloration image 4 was formed to obtain a reversible thermochromic display article 1.

In the heat decoloration image 4, the ratio of the are a of the part in which the image had been formed to the are a of the part in which the image had not been formed was 60:40 per $cm^2$.

When the reversible thermochromic display article was placed at temperatures in the range of 25-30° C., the dotty cutout pattern of an orange color was recognized because the heat decoloration image was in a colored state. The shape of the heat coloration image was not recognized at such temperatures (see FIG. 6).

Upon heating to 35° C. or higher, the heat decoloration image began to be decolored. At temperatures of 38° C. and higher, the heat coloration image was in a completely colored state and, hence, the characters "AB" of a green color were recognized (see FIG. 7).

As the temperature was lowered, the heat coloration image was decolored and the heat decoloration image was colored. The display article thus returned to the original state.

The appearance changes with temperature described above could be repeatedly produced.

Comparative Example 1

A reversible thermochromic picture book for bathing was obtained by the same method as in Example 2, except that 30 parts of heat coloration type reversible thermochromic composition E was used in place of the 30 parts of heat coloration type reversible thermochromic composition B in Example 2.

When the picture book for bathing was allowed to stand at room temperature of 25° C., "the boy's face" of an orange color was visible. However, when the picture book was placed in warm water of 40° C. or higher, "the boy's face" of an orange color disappeared and, simultaneously therewith, "the girl's face" of a pink color appeared. When this picture book was subsequently taken out of the warm water and put in 25° C. water, "the boy's face" of an orange color appeared. However, the disappearance of "the girl's face" of a pink color required much time because the heat coloration type reversible thermochromic composition E had slightly poor sharpness in decoloration. As a result, "the boy's face" and "the girl's face" overlapped each other and these patterns could not be clearly recognized.

Comparative Example 2

A reversible thermochromic mug having, formed thereon, a heat coloration image F1, a heat coloration image F2, a non-thermochromic image, and a heat decoloration image J was obtained by the same method as in Example 4, except that 30 parts of heat coloration type reversible thermochromic composition F was used in place of the 30 parts of heat coloration type reversible thermochromic composition D in Example 4.

When the reversible thermochromic mug was placed in a room-temperature atmosphere, neither the heat coloration image F1 nor the heat coloration image F2 was visible, and an egg pattern consisting of the non-thermochromic image and the heat decoloration image J was visible.

When 80° C. hot water was poured into the mug, the heat decoloration image J was decolored and the heat coloration image F1 and the heat coloration image F2 were colored. Because of this, an image appeared which showed an eggshell whose upper half had broken and a dinosaur which had hatched out. However, since the heat coloration images F1 and F2 employed heat coloration type reversible thermochromic composition F, which contained an alkoxyphenol as a color former, these images showed the following color change behaviors. The heat coloration images F1 and F2 showed a maximum color density 60° C. Thereafter, the color density gradually decreased with increasing temperature. At the time when the temperature reached 80° C., the heat coloration images F1 and F2 had a low color density as compared with the non-thermochromic image. Namely, the patterns were poorly balanced.

The invention has the constitution in which a heat coloration image containing a specific heat coloration type reversible thermochromic composition coexists with a heat decoloration image containing a heat decoloration type reversible thermochromic composition or in which a heat coloration layer containing a specific heat coloration type reversible thermochromic composition and a heat decoloration layer containing a heat decoloration type reversible thermochromic composition are superposed on each other. The invention can hence provide a reversible thermochromic display article which undergoes a variety of appearance changes when heating or cooling means is applied thereto.

Also in the case of a constitution in which a heat decoloration image containing a heat decoloration type reversible thermochromic composition partly overlies a heat coloration image containing a heat coloration type reversible thermochromic composition, a reversible thermochromic display article can be provided in which appearance changes are clearly recognized when heating or cooling means is applied thereto.

In particular, by using a gallic acid ester-containing thermochromic composition as the heat coloration type reversible thermochromic composition, a reversible thermochromic display article is obtained which can combine excellent high-temperature coloration characteristics and sharpness of thermochromism and which, when used in applications such as toys, ornaments, and printed matters, satisfies the niceties of color changes, the surprising and magical nature thereof, a diversity of designs, etc.

While the invention has been described in detail and with reference to specific embodiments thereof, it will be apparent to one skilled in the art that various changes and modifications can be made therein without departing from the scope thereof.

What is claimed is:

1. A reversible thermochromic display article which comprises a substrate and, formed thereon, both of a heat coloration image which is an image colored by heating and contains a heat coloration type reversible thermochromic composition which is colored by heating in a decolored state and is decolored by cooling in a colored state, and a heat decoloration image which is an image decolored by heating and contains a heat decoloration type reversible thermochromic composition which is decolored by heating in a colored state and is colored by cooling in a decolored state, wherein the heat coloration type reversible thermochromic composition is a heat coloration type reversible thermochromic composition in the form of microcapsules which contains an encapsulated composition comprising three essential components consisting of (a) an electron-donating chromatic organic compound, (b)' an electron-accepting compound selected from gallic acid esters, and (c) a reaction medium having a melting point lower than 50° C. which is selected from alcohols, esters, ketones, and hydrocarbons and which causes color reactions between the two components to occur reversibly at specific temperatures, the heat coloration type composition giving a temperature-color density curve in which the value of ΔH (hysteresis temperature range) is in the range of 3-40° C. and having an average particle diameter of 0.5-50 μm.

2. The reversible thermochromic display article according to claim 1, wherein the heat coloration type reversible thermochromic composition comprises microcapsules containing at least the three components (a), (b)', and (c) enclosed therein and gives a temperature-color density curve in which the value of ΔH (hysteresis temperature range) is in the range of 7-40° C.

3. The reversible thermochromic display article according to claim 1 or 2, wherein the heat coloration type reversible thermochromic composition comprises microcapsules containing enclosed therein at least the three components (a), (b)', and (c) and a fourth component which is (d) a compound selected from monomeric compounds having a melting point of 50° C. or higher and polymeric compounds having a softening point of 70° C. or higher, and gives a temperature-color density curve in which the value of ΔH (hysteresis temperature range) is in the range of 3-25° C.

4. The reversible thermochromic display article according to claim 1, wherein the heat coloration image and the heat decoloration image on the substrate are arranged side by side so as to be apart from or in contact with each other or arranged so that one of the images is partly or wholly superposed on the other.

5. The reversible thermochromic display article of claim 4, wherein the heat decoloration image partly overlies the heat coloration image, and the ratio of the are a of that part of the heat decoloration image in which this image has been formed to the are a of that part of the heat decoloration image in which this image has not been formed is from 20:80 to 99:1 per $cm^2$.

6. The reversible thermochromic display article according to claim 5, wherein the heat coloration image is in a decolored state when the heat decoloration image is in a colored state, and the heat coloration image is in a colored state when the heat decoloration image is in a decolored state.

7. The reversible thermochromic display article of claim 5, wherein the heat decoloration image in a colored state has a lightness of 4.0 or higher.

8. The reversible thermochromic display article according to claim 1, which has a non-thermochromic image formed on the substrate, the non-thermochromic image being disposed side by side with the heat coloration image or heat decoloration image or superposed thereon.

9. A reversible thermochromic display article having a multilayer structure comprising a heat coloration layer which is a layer colored by heating and contains a heat coloration type reversible thermochromic composition which is colored by heating in a decolored state and is decolored by cooling in a colored state and a heat decoloration layer which is a layer decolored by heating and contains a heat decoloration type reversible thermochromic composition which is decolored by heating in a colored state and is colored by cooling in a decolored state, wherein the heat coloration type reversible thermochromic composition is a heat coloration type reversible thermochromic composition in the form of microcapsules which contains an encapsulated composition comprising three essential components consisting of (a) an electron-donating chromatic organic compound, (b)' an electron-accepting compound selected from gallic acid esters, and (c) a reaction medium having a melting point lower than 50° C. which is selected from alcohols, esters, ketones, and hydrocarbons and which causes color reactions between the two components to occur reversibly at specific temperatures, the heat coloration type pigment giving a temperature-color density curve in which the value of ΔH (hysteresis temperature range) is in the range of 3-40° C. and having an average particle diameter of 0.5-50 μm.

10. The reversible thermochromic display article according to claim 9, wherein the heat coloration type reversible thermochromic composition comprises microcapsules containing at least the three components (a), (b)', and (c) enclosed therein and gives a temperature-color density curve in which the value of ΔH (hysteresis temperature range) is in the range of 7-40° C.

11. The reversible thermochromic display article according to claim 9 or 10, wherein the heat coloration type reversible thermochromic composition comprises microcapsules containing enclosed therein at least the three components (a), (b)', and (c) and a fourth component which is (d) a compound selected from monomeric compounds having a melting point of 50° C. or higher and polymeric compounds having a softening point of 70° C. or higher, and gives a temperature-color density curve in which the value of ΔH (hysteresis temperature range) is in the range of 3-25° C.

* * * * *